US007294048B2

(12) United States Patent
Nelson et al.

(10) Patent No.: US 7,294,048 B2
(45) Date of Patent: Nov. 13, 2007

(54) ABRASIVE ARTICLE

(75) Inventors: Eric W. Nelson, Stillwater, MN (US); Chris A. Minick, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 238 days.

(21) Appl. No.: 10/872,269

(22) Filed: Jun. 18, 2004

(65) Prior Publication Data

US 2005/0282480 A1 Dec. 22, 2005

(51) Int. Cl.
*B24D 11/00* (2006.01)

(52) U.S. Cl. ..... 451/526; 451/530; 451/533; 51/295; 51/298; 427/385.5; 428/355 EP

(58) Field of Classification Search ..... 451/526, 451/530, 533, 539; 51/295, 298, 300; 427/385.5; 428/355 EP
See application file for complete search history.

(56) References Cited

U.S. PATENT DOCUMENTS

| | | | | |
|---|---|---|---|---|
| 3,041,156 | A | | 6/1962 | Rowse |
| 4,255,164 | A | | 3/1981 | Butzke et al. |
| 4,314,827 | A | | 2/1982 | Leitheiser et al. |
| 4,623,364 | A | | 11/1986 | Cottringer et al. |
| 4,652,274 | A | | 3/1987 | Boettcher et al. |
| 4,652,275 | A | | 3/1987 | Bloecher et al. |
| 4,735,632 | A | | 4/1988 | Oxman et al. |
| 4,744,802 | A | | 5/1988 | Schwabel |
| 4,751,138 | A | | 6/1988 | Tumey et al. |
| 4,770,671 | A | | 9/1988 | Monroe et al. |
| 4,881,951 | A | | 11/1989 | Wood et al. |
| 4,903,440 | A | | 2/1990 | Larson et al. |
| 4,950,696 | A | | 8/1990 | Palazotto et al. |
| 4,985,340 | A | | 1/1991 | Palazzotto et al. |
| 4,997,461 | A | | 3/1991 | Markhoff-Matheny et al. |
| 5,009,675 | A | | 4/1991 | Kunz et al. |
| 5,011,508 | A | | 4/1991 | Wald et al. |
| 5,042,991 | A | | 8/1991 | Kunz et al. |
| 5,085,671 | A | | 2/1992 | Martin et al. |
| 5,213,951 | A | | 5/1993 | Delfino |
| 5,236,472 | A | | 8/1993 | Kirk et al. |
| 5,256,170 | A | | 10/1993 | Harmer et al. |
| 5,355,636 | A | * | 10/1994 | Harmon ..... 51/295 |
| 5,378,252 | A | | 1/1995 | Follensbee |
| 5,494,943 | A | * | 2/1996 | Mahoney et al. ..... 522/66 |
| 5,520,957 | A | * | 5/1996 | Bange et al. ..... 427/208.8 |
| 5,667,541 | A | | 9/1997 | Klun et al. |
| 5,674,122 | A | | 10/1997 | Krech |
| 5,707,903 | A | | 1/1998 | Schottenfeld |
| 5,849,052 | A | * | 12/1998 | Barber, Jr. ..... 51/298 |
| 5,849,646 | A | * | 12/1998 | Stout et al. ..... 442/68 |
| 5,975,988 | A | | 11/1999 | Christianson |
| 6,051,646 | A | * | 4/2000 | Nass et al. ..... 428/174 |
| 6,613,113 | B2 | | 9/2003 | Minick et al. |

* cited by examiner

*Primary Examiner*—Eileen P. Morgan
(74) *Attorney, Agent, or Firm*—David B. Patchett

(57) ABSTRACT

An abrasive article includes a substrate having opposed first and second surfaces, a make coat on at least a portion of the first surface, abrasive mineral particles on at least a portion of the make coat to provide an abrasive surface and a size coat arranged over at least a portion of the abrasive surface, wherein the size coat has a Young's modulus of less than 100,000 psi.

21 Claims, 1 Drawing Sheet

ABRASIVE ARTICLE

FIELD

The present invention relates generally to abrasive articles and, more particularly, to an abrasive article including a substrate, a make coat provided on the substrate, abrasive particles arranged in the make coat, and a size coat arranged over the make coat and abrasive particles, wherein the size coat has a softness that is similar to the softness of the make coat, and the size coat has a thickness that is equal to or greater than the thickness of the make coat thickness.

BACKGROUND

The usual objective of any sanding operation is to remove unwanted material from the surface being sanded and to prepare that surface for subsequent coating operations. Typically, these two objectives are diametrically opposed. Removing unwanted material from the surface in a reasonable amount of time requires the use of a coarse abrasive while preparing the surface for subsequent coating operations requires the use of a fine abrasive. Thus, the operator must sand the surface multiple times with a succession of increasingly finer grit sandpaper to achieve both objectives. The coarse sandpaper removes unwanted material quickly. However, a progression of increasingly finer sandpaper is often needed to remove the unacceptably deep scratches left in the surface by the coarse sandpaper. This entire sanding process is viewed by many as laborious, time consuming, and generally distasteful. Sandpaper manufacturers recognize this dilemma and have offered many products in an attempt to solve the problem.

Conventional sandpaper is usually produced by combining a relatively thin inflexible backing (paper, film etc.), a relatively stiff make adhesive (urea formaldehyde resin, hide glue, phenolic resin, etc.), abrasive mineral, and a relatively inflexible size resin (urea formaldehyde resin, hide glue, phenolic resin, etc.). Conventional sandpaper is thus fairly stiff and inflexible, but has an aggressive cut.

Conventional sanding sponges are relatively flexible and produce a fine scratch pattern, but lack significant cut. Flexible sanding cloths combine thick, conformable screen-like backings to make a product that has both the comfort and ease of use of conventional foam sanding sponges and the aggressive cut of conventional sandpaper. The open spaces adjacent each of the resilient bodies of the sanding cloth mesh serve as reservoirs to collect the dust generated during the sanding process. This effectively removes the sanding dust from the abrasive surface, resulting in less abrasive surface clogging and improved stock removal.

Surprisingly, the results of scratch finish testing of the sanding cloth and a conventional sanding sponge demonstrate that a significantly finer scratch pattern is left in the sanded surface by a sanding cloth than a conventional sanding sponge of comparable abrasive grit. These results can be explained by the checkerboard arrangement of small abrasive coated resilient bodies. Each of the abrasive coated resilient bodies is essentially a small sanding sponge that collectively provide unique properties. The checkerboard arrangement of the abrasive coated resilient bodies, however, also contributes to the fine finish left in the sanded surface. Because each abrasive coated resilient body is connected to an adjacent abrasive coated resilient body with an inherently flexible joint, each abrasive coated resilient body is free to follow a slightly different path across the sanded surface. This results in multiple overlapping sanding paths with a fine scratch finish. Many of the individual sanding paths will overlap each other during the surface finishing process yielding an unexpectedly fine sanding scratch pattern.

As described above, the sanding cloth material can provide desirable cut (i.e. stock removal) with less scratching (i.e. smoother finish). Certain applications outside traditional wood or metal sanding, however, require very low scratch or less harsh minerals. The fine scratch pattern and the conformable backing of the sanding cloth can be combined with "soft mineral" to achieve these desired results. Examples of low scratch applications include cleaning and scouring, polishing and buffing, cosmetics, and medical and dental applications. Furthermore, encapsulated materials may be coated as particles on the sanding cloth material. The material contained within the encapsulant would be released with product use. This would allow delivery of many types of material to the work surface, such as polishes, cleaners, and medical compounds.

SUMMARY

The present invention provides an abrasive article including a substrate having opposed first and second surfaces, a make coat on at least a portion of the first surface, abrasive mineral particles on at least a portion of the make coat to provide an abrasive surface and a size coat arranged over at least a portion of the abrasive surface, wherein the size coat has a Young's modulus of less than 100,000 psi.

In certain aspects of the invention, the substrate may be resilient and/or continuous. In other aspects, the make coat may have a Young's modulus of less than 100,000 psi or an elongation between 10% to 400%.

In one embodiment, the make coat or size coat may be a binder selected from the group consisting of acrylate resins, epoxy resins, polyol modified epoxy resins, ethylenically unsaturated resins, nitrile rubber resins, urethane resins, aminoplast resins, acrylated isocyanurate resins, isocyanurate resins, acrylated urethane resins, acrylated epoxy resins, phenolic resins, urea-formaldehyde resins, polyvinyl chloride resins, butadiene rubber resins, and combinations thereof.

In another embodiment, the present invention provides an abrasive article comprising a resilient substrate having opposed first and second surfaces, a make coat on at least a portion of the first surface, abrasive mineral particles on at least a portion of the make coat to provide an abrasive surface, and a size coat having a Young's modulus less than 100,000 psi arranged over at least a portion of the abrasive surface, wherein the ratio of make coat weight to size coat weight is less than 1:1 and greater than 1:5 and the total thickness of the make coat and size coat is less than 90% of the height of the mineral grain.

In a specific embodiment, the present invention provides an abrasive article comprising a substrate comprising a multiplicity of separated resilient bodies connected to each other in a generally planar array in a pattern which provides open spaces between adjacent connected bodies, each body having opposed first and second surfaces, a make coat on at least a portion of the first surface, wherein the make coat is a polyester urethane acrylate blend having a Young's modulus of no greater than 100,000 psi, abrasive mineral particles on at least a portion of the make coat to provide an abrasive surface, and a size coat arranged over at least a portion of the abrasive surface, wherein the size coat is a mixture of a polyol modified epoxy resin and an acrylate resin, the mixture having a Young's modulus less than 100,000 psi, wherein the ratio of make coat weight to size coat weight is less than 1:1 and greater than 1:5 and the total thickness of the make coat and size coat is less than 90% of the height of the mineral grain.

Definition of Terms

"flexible" in reference to the flexible abrasive product of the invention means that the abrasive product is sufficiently conformable to be folded over on itself without permanent deformation and will substantially redeploy to its original structure when unfolded.

"resilient" refers to a material which is sufficiently compressible to be deformed under pressure yet will return to its original configuration when the pressure is removed.

"acrylate" and "polyfunctional acrylate" are meant to include substituted acrylates such as methacrylates as well.

"epoxy resin" refers to a composition comprising at least one compound having at least one epoxy group.

"epoxy group" refers to an oxiranyl group.

"monofunctional acrylate" refers to a compound having one acryloxy group per molecule.

"photoinitiator" refers to a substance which, when exposed to light, is capable of polymerizing polymerizable groups; the polymerization may be free radical or cationic in nature.

"polyfunctional acrylate" refers to a compound having an acryloxy functionality of greater than 1.

"polyol" refers to a compound having a hydroxyl functionality greater than 1.

BRIEF DESCRIPTION OF DRAWINGS

The present invention will be further described with reference to the accompanying drawings, in which.

DETAILED DESCRIPTION OF THE INVENTION

Figure 1:
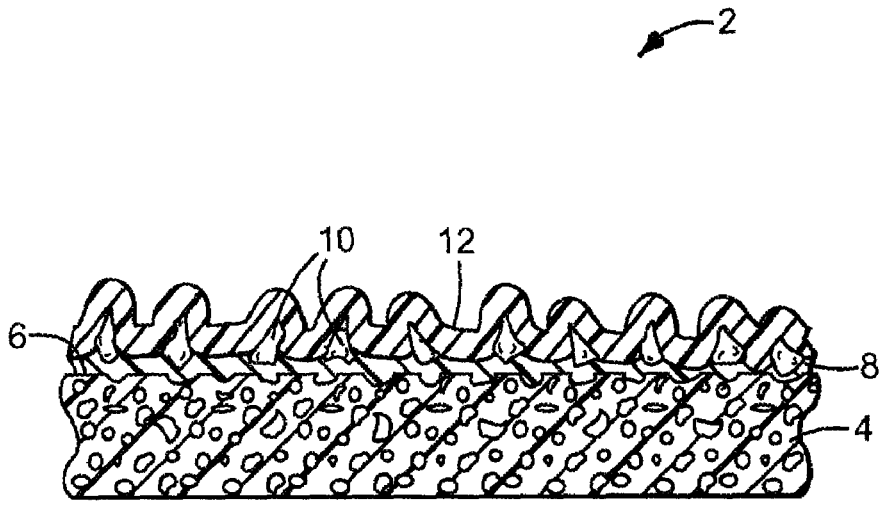
FIG. 1 is an enlarged cross-sectional view of an abrasive article according to the present invention.

Referring now to FIG. 1, there is shown a resilient abrasive article 2 including a resilient, conformable, elongatable substrate 4 having a first major surface 6 coated with a make coat 8, a plurality of abrasive particles 10 at least partially embedded within the make coat 8, and a size coat 12 applied over the make coat 8 and abrasive particles 10. While the abrasive article 2 is shown as having one major surface coated with abrasive, any or all surfaces of the substrate 4 can be coated. The substrate 4, make coat 8, particles 10, and size coat 12 are each described separately in detail below.

Substrate

In general, any substrate with at least one coatable surface may be used in the abrasive articles of the invention. These include nonwoven fabrics, woven fabrics such as cloths, screens and nets, open mesh materials, solid elastomer sheets, open-cell foam, closed-cell foam, reticulated foam, felted foam, paper, film, other known abrasive backings, and combinations of such materials. The substrate may either be foamed or non-foamed and may be composed of any of other variety of elastomeric materials including, but not limited to, polyurethane resins, polyvinyl chloride resins, ethylene vinyl acetate resins, synthetic or natural rubber compositions, acrylate resins and other suitable elastomeric resin compositions.

Suitable foam substrates can be made from synthetic polymer materials, such as, polyurethanes, foam rubbers, and silicones, or natural sponge materials. The thickness of the substrate is only limited by the desired end use of the abrasive article. The substrate generally has a sufficient thickness to make it convenient for being hand held. The thickness is measured between the highest point of the first surface of the substrate to the second surface of the substrate. The thickness preferably is between about 1 mm and about 30 mm, more preferably about 3 mm to about 25 mm.

While a square or rectangular shape of the abrasive article is preferred, the abrasive article may be any convenient geometric shape including, but not limited to, square, rectangular, triangular, circular, and in the shape of a polygon.

The substrate 4 may be continuous meaning the substrate does not contain holes, voids, or channels extending therethrough in the Z direction (i.e. the thickness or height dimension) that are larger than the randomly formed openings in the structure of the substrate itself when it is made. The substrate may be generally flat meaning it has a pair of opposed generally parallel planar surfaces and may be provided with a contoured or textured surface. Alternatively, the substrate may have an open structure wherein the substrate contains holes, voids, or channels extending therethrough in the Z direction. U.S. Pat. No. 6,613,113, which is incorporated herein by reference, describes a suitable open substrate including a plurality of separated resilient bodies that are held together in a pattern so as to provide openings between each adjacent separated body yet are connected to one another at contact points.

The substrate may be provided by die cutting, laser cutting, or water jet cutting of a solid sheet of rubber or a sheet of foam material. A suitable substrate may include a scrim including parallel threads and cross-parallel threads typically in a grid pattern that provides openings, every other one of which is closed by a resilient body in an offset pattern. While the scrim may be open in the open areas containing the resilient bodies, such areas preferably contain a substructure of parallel fibers which would be deployed within the resilient body to provide further reinforcement.

Such substrates are formed by dipping a scrim into a liquid which is curable to form a polyvinylchloride (PVC) foam and curing by placing the dipped scrim in an oven which causes the composition to expand and solidify. These substrates are well known and commercially available under the trade names OMNI-GRIP, MAXI-GRIP, ULTRA GRIP, EIRE-GRIP, and LOC-GRIP from Griptex Industries, Inc. of Calhoun, Ga. These products may be made according to U.S. Pat. No. 5,707,903 (Schottenfeld), incorporated herein by reference.

Certain of these commercial substrates may be adversely altered by heating to cure binder precursors which require elevated cure temperatures. Certain UV cured binder precursors, which require a lower temperature cure, have been found to avoid this problem. Examples of useable thermosetting resinous adhesives suitable for use in making the products of this invention include, without limitation, epoxy resins, vinyl ether resins, acrylate resins, acrylated isocyanurate resins, acrylated urethane resins, acrylated epoxy resins, and combinations thereof.

The scrim may be made of natural or synthetic fibers which may be either knitted or woven in a network having intermittent openings spaced along the surface of the scrim. The scrim need not be woven in a uniform pattern but may also include a nonwoven random pattern. Thus, the openings may either be in a pattern or randomly spaced. The scrim network openings may be rectangular or they may have other shapes including a diamond shape, a triangular shape, an octagonal shape or a combination of these shapes.

Preferably the scrim comprises a first set of rows of separated fibers deployed in a first direction and a second set of fibers deployed in a second direction to provide a grid including multiple adjacent openings wherein resilient bodies are located in alternate openings with openings between resilient bodies being devoid of resilient bodies. The scrim may also comprise an open mesh selected from the group consisting of woven or knitted fiber mesh, synthetic fiber mesh, natural fiber mesh, metal fiber mesh, molded thermoplastic polymer mesh, molded thermoset polymer mesh, perforated sheet materials, slit and stretched sheet materials and combinations thereof.

The composition of the resilient bodies may either be foamed or non-foamed and may be composed of any of other variety of elastomeric materials including, but not limited to, polyurethane resins, polyvinyl chloride resins, ethylene vinyl acetate resins, synthetic or natural rubber compositions, acrylate resins and other suitable elastomeric resin compositions.

The substrate has a sufficient thickness to make it convenient for being hand held. The thickness is measured between the highest point of the first surface of the resilient body to the second surface of the resilient body. The thickness preferably is between about 1 mm and about 15 mm, more preferably about 3 mm to about 10 mm.

While a square or rectangular shape of the resilient body is preferred, the body may be any convenient geometric shape including, but not limited to, square, rectangular, triangular, circular, and in the shape of a polygon. The resilient bodies are preferably uniform in shape, but they need not be. The resilient bodies may be aligned in rows longitudinally and in a transverse direction but for some applications it may be preferable that they not be aligned because in sanding operations where the abrasive product is moved in only one direction, for example, the longitudinal direction, longitudinally aligned abrasive covered resilient bodies could produce an unwanted scratch pattern in the surface being abraded.

The dimensions of the resilient bodies may vary from about 2 to about 25 mm, preferably from 5 to 10 mm. "Each dimension" refers to the dimension of a side, if rectangular, the diameter, if circular or the maximum dimension if of an irregular shape. The shapes of the resilient bodies need not be a defined shaped but could be randomly shaped. When referring to the dimensions of the resilient body, the dimensions are intended to include the widths in the longitudinal or transverse direction or the maximum dimension of the body when measured from one side to the other notwithstanding any direction.

The openings in the substrate are generally individually smaller than the adjacent resilient body and may have dimensions on the order of about 2 mm to about 25 mm, preferably of about 5 mm to about 10 mm. The openings may be somewhat rectangular, if the resilient bodies are rectangular or they may take any other configuration depending on the shape of the adjacent resilient bodies. The shape of the openings is typically defined by the shape of the edges of the resilient bodies. The resilient bodies and the openings are generally uniformly distributed throughout the entire area of the abrasive article of the invention but this is not necessary in all cases.

Make Coat

The make coat is formed by applying a make coat precursor to the substrate. "Make coat precursor" refers to the coatable resinous adhesive material applied to the substrate to secure abrasive particles thereto. "Make coat" refers to the layer of hardened resin over the substrate formed by hardening the make coat precursor.

In certain embodiments, the thickness of the make coat adhesive is adjusted so that at least 10%, 20%, or 30% but no greater than 35%, 40% or 45% of the individual grain length protrudes above the cured make adhesive layer. Generally, larger grit minerals (smaller grit numbers) require more make adhesive than smaller grit minerals (larger grit numbers).

The make coat precursor is applied to the substrate at a coating weight which, when cured, provides the necessary adhesion to securely bond the abrasive particles to the coatable surfaces of the substrate. For typical make coats, the dry add-on weight of the make coat will range from about 1 to 20 grains/24 $in^2$ (4.2-84 $g/m^2$). In certain embodiments, the make coat dry add-on weight will have a lower limit of 2 grains/24 $in^2$ (8.4 $g/m^2$), 4 grains/24 $in^2$ (16.8 $g/m^2$), or 6 grains/24 $in^2$ (25.2 $g/m^2$), and will have an upper limit of 8 grains/24 $in^2$)33.6 $g/m^2$), 10 grains/24 $in^2$ (42 $g/m^2$), or 12 grains/24 $in^2$ (50.4 $g/m^2$).

The make coat has an elongation having a lower limit of 10%, 50%, or 75%, and an upper limit of 80%, 100%, 200%, or 400%. Suitable make coats may be formulated having a Young's modulus of less than 80,000 psi, 100,000 psi, or 120,000 psi.

The make coat layer preferably comprises organic precursor polymer subunits. The precursor polymer subunits preferably are capable of flowing sufficiently so as to be able to coat a surface. Solidification of the precursor polymer subunits may be achieved by curing (e.g., polymerization and/or cross-linking), by drying (e.g., driving off a liquid) and/or simply by cooling. The precursor polymer subunits may be an organic solvent borne, a water-borne, or a 100% solids (i.e., a substantially solvent-free) composition. Both thermoplastic and/or thermosetting polymers, or materials, as well as combinations thereof, may be used as precursor polymer subunits. Upon the curing, drying or cooling of the precursor polymer subunits, the composition forms the make coat. The preferred precursor polymer subunits can be either a condensation curable resin or an addition polymerizable resin. The addition polymerizable resins can be ethylenically unsaturated monomers and/or oligomers. Examples of useable crosslinkable materials include phenolic resins, bismaleimide binders, vinyl ether resins, aminoplast resins having pendant alpha, beta unsaturated carbonyl groups, urethane resins, epoxy resins, acrylate resins, acrylated isocyanurate resins, urea-formaldehyde resins, isocyanurate resins, acrylated urethane resins, acrylated epoxy resins, or mixtures thereof.

The precursor polymer subunits are preferably a curable organic material (i.e., a polymer subunit or material capable of polymerizing and/or crosslinking upon exposure to heat and/or other sources of energy, such as electron beam, ultraviolet light, visible light, etc., or with time upon the addition of a chemical catalyst, moisture, or other agent which cause the polymer to cure or polymerize). Precursor polymer subunits examples include amino polymers or aminoplast polymers such as alkylated urea-formaldehyde polymers, melamine-formaldehyde polymers, and alkylated benzoguanamine-formaldehyde polymer, acrylate polymers including acrylates and methacrylates alkyl acrylates, acrylated epoxies, acrylated urethanes, acrylated polyesters, acrylated polyethers, vinyl ethers, acrylated oils, and acrylated silicones, alkyd polymers such as urethane alkyd polymers, polyester polymers, reactive urethane polymers, phenolic polymers such as resole and novolac polymers, phenolic/latex polymers, epoxy polymers such as bisphenol epoxy polymers, polyol modified epoxy polymers, isocyanates, isocyanurates, polysiloxane polymers including alkylalkoxysilane polymers, or reactive vinyl polymers. The resulting binder may be in the form of monomers, oligomers, polymers, or combinations thereof.

The aminoplast precursor polymer subunits have at least one pendant alpha, beta-unsaturated carbonyl group per molecule or oligomer. These polymer materials are further described in U.S. Pat. No. 4,903,440 (Larson et al.) and U.S. Pat. No. 5,236,472 (Kirk et al.), both incorporated herein by reference.

Preferred cured abrasive coatings are generated from free radical curable precursor polymer subunits. These precursor polymer subunits are capable of polymerizing rapidly upon an exposure to thermal energy and/or radiation energy. One preferred subset of free radical curable precursor polymer subunits include ethylenically unsaturated precursor polymer subunits. Examples of such ethylenically unsaturated precursor polymer subunits include aminoplast monomers or oligomers having pendant alpha, beta unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions, and mixtures thereof. The term acrylate includes both acrylates and methacrylates.

Ethylenically unsaturated precursor polymer subunits include both monomeric and polymeric compounds that contain atoms of carbon, hydrogen and oxygen, and optionally, nitrogen and the halogens. Oxygen or nitrogen atoms or both are generally present in the form of ether, ester, urethane, amide, and urea groups. The ethylenically unsaturated monomers may be monofunctional, difunctional, trifunctional, tetrafunctional or even higher functionality, and include both acrylate and methacrylate-based monomers. Suitable ethylenically unsaturated compounds are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, or maleic acid. Representative examples of ethylenically unsaturated monomers include methyl methacrylate, ethyl methacrylate, styrene, divinylbenzene, hydroxyethyl acrylate, hydroxyethyl methacrylate, hydroxypropyl acrylate, hydroxy propyl methacrylate, hydroxybutyl acrylate, hydroxybutyl methacrylate, lauryl acrylate, octyl acrylate, caprolactone acrylate, caprolactone methacrylate, tetrahydrofurfuryl methacrylate, cyclohexyl acrylate, stearyl acrylate, 2-phenoxyethyl acrylate, isooctyl acrylate, isobornyl acrylate, isodecyl acrylate, polyethylene glycol monoacrylate, polypropylene glycol monoacrylate, vinyl toluene, ethylene glycol diacrylate, polyethylene glycol diacrylate, ethylene glycol dimethacrylate, hexanediol diacrylate, triethylene glycol diacrylate, 2-(2-ethoxyethoxy) ethyl acrylate, propoxylated trimethylol propane triacrylate, trimethylolpropane triacrylate, glycerol triacrylate, pentaerthyitol triacrylate, pentaerythritol trimethacrylate, pentaerythritol tetraacrylate and pentaerythritol tetramethacrylate. Other ethylenically unsaturated materials include monoallyl, polyallyl, or polymethallyl esters and amides of carboxylic acids, such as diallyl phthalate, diallyl adipate, or N,N-diallyladipamide. Still other nitrogen containing ethylenically unsaturated monomers include tris(2-acryloxyethyl)isocyanurate, 1,3,5-tri(2-methyacryloxyethyl)-s-triazine, acrylamide, methylacrylamide, N-methyl-acrylamide, N,N-dimethylacrylamide, N-vinylpyrrolidone, or N-vinylpiperidone.

A preferred precursor polymer subunits contains a blend of two or more acrylate monomers. For example, the precursor polymer subunits may be a blend of trifunctional acrylate and a monofunctional acrylate monomers. An example of one precursor polymer subunits is a blend of propoxylated trimethylol propane triacrylate and 2-(2-ethoxyethoxy) ethyl acrylate.

It is also feasible to formulate a precursor polymer subunits from a mixture of an acrylate and an epoxy polymer, e.g., as described in U.S. Pat. No. 4,751,138 (Tumey et al.), incorporated herein by reference.

Other precursor polymer subunits include isocyanurate derivatives having at least one pendant acrylate group and isocyanate derivatives having at least one pendant acrylate group are further described in U.S. Pat. No. 4,652,274 (Boettcher et al.), incorporated herein by reference. The preferred isocyanurate material is a triacrylate of tris(hydroxyethyl) isocyanurate.

Still other precursor polymer subunits include diacrylate urethane esters as well as polyacrylate or poly methacrylate urethane esters of hydroxy terminated isocyanate extended polyesters or polyethers. Examples of commercially available acrylated urethanes include those under the trade name "UVITHANE 782," available from Morton Chemical, Moss Point, Miss.; "CMD 6600," "CMD 8400," and "CMD 8805," available from UCB Radcure Specialties, Smyrna, Ga.; "PHOTOMER" resins (e.g., PHOTOMER 6010) from Henkel Corp., Hoboken, N.J.; "EBECRYL 220" (hexafunctional aromatic urethane acrylate), "EBECRYL 284" (aliphatic urethane diacrylate of 1200 diluted with 1,6-hexanediol diacrylate), "EBECRYL 4827" (aromatic urethane diacrylate), "EBECRYL 4830" (aliphatic urethane diacrylate diluted with tetraethylene glycol diacrylate), "EBECRYL 6602" (trifunctional aromatic urethane acrylate diluted with trimethylolpropane ethoxy triacrylate), "EBECRYL 840" (aliphatic urethane diacrylate), and "EBECRYL 8402" (aliphatic urethane diacrylate) from UCB Radcure Specialties; and "SARTOMER" resins (e.g., "SARTOMER" 9635, 9645, 9655, 963-B80, 966-A80, CN980M50, etc.) from Sartomer Co., Exton, Pa.

Yet other precursor polymer subunits include diacrylate epoxy esters as well as polyacrylate or polymethacrylate epoxy ester such as the diacrylate esters of bisphenol A epoxy polymer. Examples of commercially available acrylated epoxies include those under the trade name "CMD 3500," "CMD 3600," and "CMD 3700," available from UCB Radcure Specialties.

Other precursor polymer subunits may also be acrylated polyester polymers. Acrylated polyesters are the reaction products of acrylic acid with a dibasic acid/aliphatic diol-based polyester. Examples of commercially available acrylated polyesters include those known by the trade designations "PHOTOMER 5007" (hexafunctional acrylate), and "PHOTOMER 5018" (tetrafunctional tetracrylate) from Henkel Corp.; and "EBECRYL 80" (tetrafunctional modified polyester acrylate), "EBECRYL 450" (fatty acid modified polyester hexaacrylate) and "EBECRYL 830" (hexafunctional polyester acrylate) from UCB Radcure Specialties.

Another preferred precursor polymer subunits is a blend of ethylenically unsaturated oligomer and monomers. For example the precursor polymer subunits may comprise a blend of an acrylate functional urethane oligomer and one or more monofunctional acrylate monomers. This acrylate monomer may be a pentafunctional acrylate, tetrafunctional acrylate, trifunctional acrylate, difunctional acrylate, monofunctional acrylate polymer, or combinations thereof.

The precursor polymer subunits may also be an acrylate dispersion like that described in U.S. Pat. No. 5,378,252 (Follensbee), incorporated herein by reference.

In addition to thermosetting polymers, thermoplastic binders may also be used. Examples of suitable thermoplastic polymers include polyamides, polyethylene, polypropylene, polyesters, polyurethanes, polyetherimide, polysulfone, polystyrene, acrylonitrile-butadiene-styrene block copolymer, styrene-butadiene-styrene block copolymers, styrene-isoprene-styrene block copolymers, acetal polymers, polyvinyl chloride and combinations thereof.

Water-soluble precursor polymer subunits optionally blended with a thermosetting resin may be used. Examples of water-soluble precursor polymer subunits include polyvinyl alcohol, hide glue, or water-soluble cellulose ethers such as hydroxypropylmethyl cellulose, methyl cellulose or hydroxyethylmethyl cellulose. These binders are reported in U.S. Pat. No. 4,255,164 (Butkze et al.), incorporated herein by reference.

In the case of precursor polymer subunits containing ethylenically unsaturated monomers and oligomers, polymerization initiators may be used. Examples include organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, or mixtures thereof. Examples of suitable commercially available, ultraviolet-activated photoinitiators have trade names such as "IRGACURE 651," "IRGACURE 184," and "DAROCUR 1173" commercially available from Ciba Specialty Chemicals, Tarrytown, N.Y. Another visible light-activated photoinitiator has the trade name "IRGACURE 369" commercially available from Ciba Geigy Company. Examples of suitable visible light-activated initiators are reported in U.S. Pat. No. 4,735,632 (Oxman et al.) and U.S. Pat. No. 5,674,122 (Krech et al.)

A suitable initiator system may include a photosensitizer. Representative photosensitizers may have carbonyl groups or tertiary amino groups or mixtures thereof. Preferred photosensitizers having carbonyl groups are benzophenone, acetophenone, benzil, benzaldehyde, o-chlorobenzaldehyde, xanthone, thioxanthone, 9,10-anthraquinone, or other aromatic ketones. Preferred photosensitizers having tertiary amines are methyldiethanolamine, ethyldiethanolamine, triethanolamine, phenylmethyl-ethanolamine, or dimethylaminoethylbenzoate. Commercially available photosensitizers include "QUANTICURE ITX," "QUANTICURE QTX," "QUANTICURE PTX," "QUANTICURE EPD" from Biddle Sawyer Corp.

In general, the amount of photosensitizer or photoinitiator system may vary from about 0.01 to 10% by weight, more preferably from 0.25 to 4.0% by weight of the components of the precursor polymer subunits.

Additionally, it is preferred to disperse (preferably uniformly) the initiator in the precursor polymer subunits before addition of any particulate material, such as the abrasive particles and/or filler particles.

In general, it is preferred that the precursor polymer subunits be exposed to radiation energy, preferably ultraviolet light or visible light, to cure or polymerize the precursor polymer subunits. In some instances, certain abrasive particles and/or certain additives will absorb ultraviolet and visible light, which may hinder proper cure of the precursor polymer subunits. This occurs, for example, with ceria abrasive particles. The use of phosphate containing photoinitiators, in particular acylphosphine oxide containing photoinitiators, may minimize this problem. An example of such an acylphosphate oxide is 2,4,6-trimethylbenzoyl-diphenylphosphine oxide, which is commercially available from BASF Corporation, Ludwigshafen, Germany, under the trade designation "LUCIRIN TPO-L." Other examples of commercially available acylphosphine oxides include "DAROCUR 4263" and "DAROCUR 4265" commercially available from Ciba Specialty Chemicals.

Cationic initiators may be used to initiate polymerization when the binder is based upon an epoxy or vinyl ether. Examples of cationic initiators include salts of onium cations, such as arylsulfonium salts, as well as organometallic salts such as ion arene systems. Other examples are reported in U.S. Pat. No. 4,751,138 (Tumey et al.); U.S. Pat. No. 5,256,170 (Harmer et al.); U.S. Pat. No. 4,985,340 (Palazzotto) and U.S. Pat. No. 4,950,696, all incorporated herein by reference.

Dual-cure and hybrid-cure photoinitiator systems may also be used. In dual-cure photoiniator systems, curing or polymerization occurs in two separate stages, via either the same or different reaction mechanisms. In hybrid-cure photoinitiator systems, two curing mechanisms occur at the same time upon exposure to ultraviolet/visible or electron-beam radiation.

The make coat is applied to at least one side of the substrate and may be applied to any number of surfaces. The make coat binder precursor can be coated by any conventional technique, such as knife coating, spray coating, roll coating, rotogravure coating, curtain coating, and the like. The abrasive coating is typically applied to the surfaces coated with make coat. If applied to two surfaces, the abrasive particle size may be the same for each side or may be different for each side. Once the substrate is provided, the introduction of abrasive particles and several adhesive layers, which are typically applied in binder precursor form, is contemplated in the context of forming the abrasive layer of the coated abrasive product.

Abrasive Particles

The abrasive particles suitable for this invention include fused aluminum oxide, heat treated aluminum oxide, alumina-based ceramics, silicon carbide, zirconia, alumina-zirconia, garnet, diamond, ceria, cubic boron nitride, ground glass, quartz, titanium diboride, sol gel abrasives and combinations thereof. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), all incorporated herein after by reference. The abrasive particles can be either shaped (e.g., rod, triangle, or pyramid) or unshaped (i.e., irregular). The term "abrasive particle" encompasses abrasive grains, agglomerates, or multi-grain abrasive granules. Examples of such agglomerates are described in U.S. Pat. No. 4,652,275 (Bloecher, et al.) and U.S. Pat. No. 5,975,988 (Christianson) and assigned to the assignee of the present invention, each being incorporated herein by reference. The agglomerates can be irregularly shaped or have a precise shape associated with them, for example, a cube, pyramid, truncated pyramid, or a sphere. An agglomerate comprises abrasive particles or grains and a bonding agent. The bonding agent can be organic or inorganic. Examples of organic binders include phenolic resins, urea-formaldehyde resins, and epoxy resins. Examples of inorganic binders include metals (such as nickel), and metal oxides. Metal oxides are usually classified as either a glass (vitrified), ceramic (crystalline), or glass-ceramic. Further information on ceramic agglomerates is disclosed in U.S. Pat. No. 5,975,988 (Christianson) assigned to the assignee of the present invention.

Useful aluminum oxide grains for applications of the present invention include fused aluminum oxides, heat treated aluminum oxides, and ceramic aluminum oxides. Examples of such ceramic aluminum oxides are disclosed in U.S. Pat. No. 4,314,827 (Leitheiser, et al.), U.S. Pat. No. 4,744,802 (Schwabel), U.S. Pat. No. 4,770,671 (Monroe, et al.), and U.S. Pat. No. 4,881,951 (Wood, et al.).

Other abrasive particles particularly suited for applications beyond the traditional abrasive application such as cleaning, scouring, polishing and buffing, cosmetics, medical and dental applications which require low scratch and therefore less harsh mineral include shells (eg. walnut, coconut, etc), pumice, talc, calcium carbondate, and synthetic plastics (PVC, acrylic, etc.).

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the dispersibility of the abrasive particles in the precursor polymer subunits. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Wald et al.); U.S. Pat. No. 5,213,951 (Celikkaya et al.); U.S. Pat. No. 5,085,671 (Martin et al.) and U.S. Pat. No. 5,042,991 (Kunz et al.), the disclosures of which are incorporated herein by reference.

The average particle size of the abrasive particle for advantageous applications of the present invention is at least about 0.1 micrometer, preferably at least about 65 micrometers. A particle size of about 100 micrometers corresponds approximately to a coated abrasive grade 150 abrasive grain, according to American National Standards Institute (ANSI) Standard B74.18-1984. The abrasive grain can be oriented, or it can be applied to the substrate without orientation, depending upon the desired end use of the abrasive article.

The abrasive particles can be embedded into the make coat precursor by any conventional technique such as electrostatic coating or drop coating. During electrostatic coating, electrostatic charges are applied to the abrasive particles and this propels the abrasive particles upward. Electrostatic coating tends to orient the abrasive particle, which generally leads to better abrading performance. In drop coating, the abrasive particles are forced from a feed station and fall into the binder precursor by gravity. It is also within the scope of this invention to propel the abrasive particles upward by a mechanical force into the binder precursor.

Size Coat

A size coat is applied over the make coat and abrasive particles, and may be coated by any conventional technique, such as knife coating, spray coating, roll coating, curtain coating, rotogravure coating, and the like. The purpose of this adhesive layer is to bind the individual mineral particles together so they all act in unison during the sanding process. The thickness of the size adhesive layer varies with individual mineral grain sizes. Coarser minerals (smaller grit numbers) require more size adhesive than finer minerals (larger grit numbers). The dry add-on weight of the size coat ranges from a lower limit of 5 grains/24 $in^2$ (42 $g/m^2$) to an upper limit of 40 grains/24 $in^2$ (168 $g/m^2$). In certain embodiments, the dry add-on weight of the size coat may have a lower limit of 14 grains/24 $in^2$ (58.8 $g/m^2$), 16 grains/24 $in^2$(67.2 $g/m^2$), or 19 grains/24 $in^2$ (79.8 $g/m^2$), and an upper limit of 22 grains/24 $in^2$(92.4 $g/m^2$) 24 grains/24 $in^2$ (100.8 $g/m^2$), or 30 grains/24 $in^2$ (126 $g/m^2$).

In certain embodiments, the size coat adhesive is adjusted to a thickness equal to at least 55% or 60% but no greater than 70%, 80% or 90% of the individual abrasive mineral grain length. The total thickness of the make coat and size coat combined is preferably less than 90% of the length of the abrasive mineral grain.

In accordance with one aspect of the invention, the ratio of make coat weight to size coat weight is no greater than 1:1 and is preferably greater than 1:5. A particularly suitable ratio of make coat weight to size coat weight is between 1:1.5 to 1:2.5. The size coat has an elongation having a lower limit of 10%, 50%, or 75%, and an upper limit of 80%, 100%, 200%, or 400%. Suitable size coats may be formulated having a Young's modulus of less than 80,000 psi, 100,000 psi, or 120,000 psi.

The curable size coat layer preferably comprises organic precursor polymer subunits such as those described above with respect to the make coat.

The make and size coats may contain other materials that are commonly utilized in coated abrasive products. These materials, referred to as additives, include grinding aids, fillers, coupling agents, wetting agents, dyes, pigments, plasticizers, release agents, or combinations thereof. One would not typically use more of these materials than needed for desired results. Fillers are typically present in no more than an amount of about 90 wt %, for either the make or size coat, based upon the weight of the adhesive. Examples of useful fillers include calcium salts, such as calcium carbonate and calcium metasilicate, silica, metals, carbon, or glass.

General Method of Making

The abrasive article of the present invention may be made by providing a flexible sheet-like substrate. A first surface of the sheet substrate is coated with a make coating formulation comprising a curable binder composition. This can be applied by a high pressure spray gun or a roll coater. The coating station can be any conventional coating means such as drop die coater, knife coater, curtain coater, vacuum die coater or a die coater. During coating, the formation of air bubbles is preferably minimized. Abrasive particles are deposited onto the make coating of the curable composition.

Energy is transmitted into the curable abrasive composite layer by an energy source to at least partially cure the make coat. The selection of the energy source will depend in part upon the chemistry of the precursor make coat. The energy source should not appreciably degrade the substrate. Partial cure of the precursor make coat means that the precursor make coat is polymerized to such a state that the curable abrasive composite layer does not flow when inverted.

The energy source may be a source of thermal energy or radiation energy, such as electron beam, ultraviolet light, or visible light. The amount of energy required depends on the chemical nature of the reactive groups in the precursor polymer subunits, as well as upon the thickness and density of the binder slurry. For thermal energy, an oven temperature from about 75° C. to about 150° C. and a duration from about 5 minutes to about 60 minutes are generally sufficient. Electron beam radiation or ionizing radiation may be used at an energy level of about 0.1 to about 10 Mrad, preferably at an energy level of about 1 to about 10 Mrad. Ultraviolet radiation includes radiation having a wavelength within a range of about 200 to about 400 nanometers, preferably within a range of about 250 to 400 nanometers. Visible radiation includes radiation having a wavelength within a range of about 400 to about 800 nanometers, preferably in a range of about 400 to about 550 nanometers.

A size coating formulation comprising a curable binder composition is coated over the abrasive particles and the size binder composition is cured either by heat, electron beam or UV curing.

EXAMPLES

The following non-limiting examples will further illustrate the invention. All parts are by weight percent unless otherwise indicated.

Glossary of Terms

CN 973

CN 973 is the trade designation for urethane acrylate oligomer from Sartomer Company Inc., Exton, Pa.

ERL4221

ERL 4221 is the trade designation for a cycloaliphatic epoxy resin from Dow Chemical, Midland, Mich.

IRGACURE 651

IRGACURE 651 is the trade designation for 2,2-dimethyl-1,2-diphenyl-1-ethanone free radical photoinitiator from Ciba Corporation, Tarrytown, N.Y.

IRGACURE 819

IRGACURE 819 is the trade designation for bis-phosphine oxide photoinitiator available from Ciba Corporation, Tarrytown, N.Y.

SR 504

SR 504 is the trade designation for ethoxylated nonylphenol acrylate available from Sartomer Company Inc., Exton, Pa.

SR 9003

SR 9003 is the trade designation for propoxylated neopentyl glycol diacrylate available from Sartomer Company Inc., Exton, Pa.

SR 9051

SR 9051 is the trade designation for trifunctional acid ester available from Sartomer Company Inc., Exton, Pa.

TMPTA

TMPTA is the trade designation for trimethylolpropanetriacrylate crosslinking aid available from UCB Chemicals Corporation, North Augusta, S.C.

Tone Polyol 230

Tone Polyol 230 is the trade designation for Polycaprolactone Diol, available from Union Carbide Corporation, Danbury Conn.

UVI 6976

UVI 6976 is the trade designation for triarysulfonium hexafluoroantimonate cationic photoinitiator, available from Sartomer Company Inc., Exton, Pa.

Substrate Materials Used in Examples

| Substrate | Material |
|---|---|
| A | 5 mm polyurethane foam |
| B | 5 mm polyurethane foam with a 1 cm by 1 cm Cross-Cut pattern |
| C | 5 mm polyurethane foam with Polyester-PVC Perforated Foam |
| D | Polyester scrim - PVC Foam Rug Holder |
| E | Polyester - PVC Perforated Foam Sanding Cloth |
| F | Polyester - PVC Perforated Foam Sanding Cloth with standard abrasive paper backing |

Example 1

An acrylic make coat adhesive precursor "Formulation M-1," was made by mixing 59.7% CN 973, 7.46% SR 504, 24.87% SR 9003, 7.46% SR 9051, and 0.50% IRG 819 in a suitable size vessel. This UV cured formulation is 100% solids.

A 23 cm by 60 cm piece of flexible substrate A was weighed to determine its basis for further processing. Substrate A was a 5 mm thick polyurethane, open-cell foam, identified under the trade designation Crest-Style 482C, and is manufactured by Crest Foam Inc., New Jersey.

The make coat precursor M-1 was applied using a small two roll coater to the foam surface of flexible-sheet like substrate A. This roll-coater was a standard two roll type coater equipped with a 10 cm (4-inch) diameter rubber covered bottom roll and a 10 cm (4-inch) diameter rubber covered top roller. The bottom roller was fitted with a knife bar for adhesive metering purposes. The sample was weighed to determine the dry add-on weight, which was 29 $g/m^2$.

Aluminum Oxide grade 120 mineral abrasive particles were then evenly applied to the wet surface with a forced air mineral delivery system. The dry add-on weight of the abrasive particles was 126 $g/m^2$.

Formulation M-1 was cured using a UV light chamber. A conveyer belt for moving the coated sample through the UV light chamber was adjusted to 10 m/min. The UV light chamber is produced by American Ultraviolet Company, Lebanon, Ind., model #CV-12-400 WPI Variable. This system uses a medium pressure mercury arc lamp to produce the UV light used to initiate the curing reaction. Its input power was 4000 watts and output power was 600 $mJ/cm^2$ of UVA radiation (300-400 nm) at 10 m/min. The chamber was fitted with a 30 cm (12 inch) wide conveyor system to transport the sample under the light source. The mineral coated composite was placed on the conveyer and the sample was exposed to UV radiation as the sample passed through the light chamber to provide total light exposure of 1,200 $mJ/cm^2$.

An epoxy size coat adhesive precursor, "Formulation S-1," was made by mixing; 43.65% ERL 4221, 9.70% TMPTA, 43.65% Tone 230, 2.00% UVI6976, and 1.00% IRG 651 in a suitable size vessel. The size coat precursor was roll coated on the make and mineral coated substrate A using the roll coater described above. The dry add-on weight was 84 $g/m^2$. The size-coated sample was placed on the conveyor of the UV curing chamber, running at 10 m/min., and passed through the light chamber to provide total light exposure of 1,200 $mJ/cm^2$.

The completed sample was allowed to equilibrate to room temperature condition before testing.

Example 2

The same acrylic make coat adhesive precursor "Formulation M-1," substrate A, and mineral coat were applied and cured as described in Example 1.

An epoxy size coat adhesive precursor, "Formulation S-2," was made by mixing; 67.9% UVI 6110, 29.1% TMPTA, 2.00% UVI 6976, and 1.00% IRG 651 in a suitable sized vessel. The size coat precursor was roll coated on the make and mineral coated substrate A using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 3

The acrylic make coat adhesive precursor "Formulation M-1," described in Example 1, was used for this example. A 23 cm by 60 cm piece of flexible substrate B was weighed to determine its basis for further processing. Substrate B was a 5 mm thick polyurethane, open-cell foam, identified under the trade designation Crest-Style 482C, and is manufactured by Crest Foam Inc., New Jersey. The top surface of the foam was embossed with a 1 cm wide by 1 cm long pattern to a depth of 2 mm forming individual resilient bodies, with a 1 mm gap between bodies. Approximately 83% of the surface was composed of solid material with the remaining 17% being void space. The size of the resilient bodies is adjustable with this substrate.

The make coat precursor was roll coated on substrate B as described in Example 1. The dry add on weight was 29 g/m$^2$. Aluminum Oxide grade 120 mineral abrasive particles were then evenly applied to the wet surface with a forced air mineral delivery system. The dry add-on weight of the abrasive particles was 126 g/m$^2$. The coated substrate B sample was cured as described in Example 1.

The epoxy size coat adhesive precursor, "Formulation S-1," was roll coated on the make and mineral coated substrate B using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was removed from the oven and allowed to equilibrate to room temperature condition before testing.

Example 4

The same acrylic make coat adhesive precursor "Formulation M-1," substrate B, and mineral coat were applied and cured as described in Example 3.

The epoxy size coat adhesive precursor, "Formulation S-2," was roll coated on the make and mineral coated substrate B using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 5

The acrylic make coat adhesive precursor "Formulation M-1," described in Example 1, was used for this example. A 23 cm by 60 cm piece of flexible substrate C was weighed to determine its basis for further processing. Substrate C was a 23 cm by 60 cm piece of flexible substrate E adhered to the top of a 23 cm by 60 cm piece of flexible substrate A.

The make coat precursor was roll coated on substrate C as described in Example 1. The dry add on weight was 29 g/m$^2$. Aluminum Oxide grade 120 mineral abrasive particles were then evenly applied to the wet surface with a forced air mineral delivery system. The dry add-on weight of the abrasive particles was 126 g/m$^2$. The coated substrate C sample was cured as described in Example 1 The epoxy size coat adhesive precursor, "Formulation S-1," was roll coated on the make and mineral coated substrate C using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 6

The same acrylic make coat adhesive precursor "Formulation M-1," substrate C, and mineral coat were applied and cured as described in Example 5.

The epoxy size coat adhesive precursor, "Formulation S-2," was roll coated on the make and mineral coated substrate C using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 7

The acrylic make coat adhesive precursor-"Formulation M-1," described in Example 1, was used for this example. A 23 cm by 60 cm piece of flexible substrate D was weighed to determine its basis for further processing. Substrate D was 3 mm thick waffle-pattern, polyester scrim, with woven fiber reinforcement. Substrate D was identified under the trade designation Megaloc, manufactured by a company in Dalton, Ga. The individual resilient bodies were spaced with an approximately 0.5 cm wide and 1 cm long oval gap, with approximately 2 mm of resilient bodies between empty ovals. Approximately 90% of the surface was composed of void space and with the remaining 10% being solid material. However, the entire surface, high and low areas, was coated with abrasive material.

The make coat precursor was roll coated on substrate D as described in Example 1. The dry add on weight was 29 g/m$^2$. Aluminum Oxide grade 120 mineral abrasive particles were then evenly applied to the wet surface with a forced air mineral delivery system. The dry add-on weight of the abrasive particles was 126 g/m$^2$. The coated substrate D sample was cured as described in Example 1 The epoxy size coat adhesive precursor, "Formulation S-1," was roll coated on the make and mineral coated substrate D using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 8

The same acrylic make coat adhesive precursor "Formulation M-1," substrate D, and mineral coat were applied and cured as described in Example 7.

The epoxy size coat adhesive precursor, "Formulation S-2," was roll coated on the make and mineral coated substrate D using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 9

The acrylic make coat adhesive precursor "Formulation M-1," described in Example 1, was used for this example. A 23 cm by 60 cm piece of flexible Substrate E was weighed to determine its basis for further processing. Substrate E was a 3 mm thick open-mesh, resilient, non-slip, matting made from a scrim reinforced polyvinyl chloride foam. Substrate A was identified under the trade designation Salton Anti-Slip Matting, available from Liggett & Platt, Vantage Division, Atlanta Ga. The individual resilient bodies were approximately 4 mm wide and 4.8 mm long. Each body had a slight hemispherical domed upper surface shape. Approximately 68% of the surface was composed of solid material with the remaining 32% being void space. Products similar to this are manufactured by Griptex Industries, Inc., Cartersville, Ga.

The make coat precursor was roll coated on substrate E as described in Example 1. The dry add on weight was 29 g/m$^2$. Aluminum Oxide grade 120 mineral abrasive particles were then evenly applied to the wet surface with a forced air mineral delivery system. The dry add-on weight of the abrasive particles was 126 g/m$^2$. The coated substrate E sample was cured as described in Example 1

The epoxy size coat adhesive precursor, "Formulation S-1," was roll coated on the make and mineral coated substrate E using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 10

The same acrylic make coat adhesive precursor "Formulation M-1," substrate E, and mineral coat were applied and cured as described in Example 9.

The epoxy size coat adhesive precursor, "Formulation S-2," was roll coated on the make and mineral coated substrate E using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 11

The acrylic make coat adhesive precursor "Formulation M-1," described in Example 1, was used for this example. A 23 cm by 60 cm piece of flexible substrate F was weighed to determine its basis for further processing. Substrate F was a 3 mm thick open-mesh, resilient, non-slip, matting made from a scrim reinforced polyvinyl chloride foam. Substrate F was identified under the trade designation Salton Anti-Slip Matting, available from Liggett & Platt, Vantage Division, Atlanta, Ga. The individual resilient bodies were approximately 4 mm wide and 4.8 mm long. Each body had a slight hemispherical domed upper surface shape. Approximately 68% of the surface was composed of solid material with the remaining 32% being void space. This open substrate was adhered to a standard abrasive paper backing, C-weight, 120 g/m$^2$, before coating.

The make coat precursor was roll coated on substrate F as described in Example 1. The dry add on weight was 29 g/m$^2$. Aluminum Oxide grade 120 mineral abrasive particles were then evenly applied to the wet surface with a forced air mineral delivery system. The dry add-on weight of the abrasive particles was 126 g/m$^2$. The coated substrate F sample was cured as described in Example 1

The epoxy size coat adhesive precursor, "Formulation S-1," was roll coated on the make and mineral coated substrate F using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Example 12

The same acrylic make coat adhesive precursor "Formulation M-1," substrate F, and mineral coat were applied and cured as described in Example 9.

The epoxy size coat adhesive precursor, "Formulation S-2," was roll coated on the make and mineral coated substrate F using the roll coater described in Example 1. The dry add-on weight was 84 g/m$^2$. The size-coated sample was placed on the conveyor of the UV curing chamber, running at 10 m/min., and passed through the light chamber to provide total light exposure of 1,200 mJ/cm$^2$.

The completed sample was allowed to equilibrate to room temperature condition before testing.

Testing Procedures

Finish Testing

"Surface Finish" is a measure of the character of the scratches created by the abrasive on the work piece. They are numerically indicated by the roughness number of depths as measured by a profilometer. This scratch/finish measurement instrument was a PERTHOMETER model M4P Surface Measuring and Recording Instrument manufactured by Feinpruf Perthen GmbH. The numbers generated by the profilometer are termed $R_A$, $R_Z$, and $R_{MAX}$.

$R_A$ is the average roughness (DIN 4768)—the arithmetic mean of the roughness profile within the total measurement length (2.54 mm).

$R_Z$ is the average roughness (DIN 4768)—the mean of the individual roughness depths. The average of the vertical distance between the highest and the lowest points in the roughness profile.

$R_{MAX}$ is the maximum roughness depth (DIN 4768)—the greatest individual depth occurring over the measurement distance.

The work piece used in these tests are plastic panels, 40.3 cm by 60.6 cm PLEXIGLASS plastic sheets.

A fixture to support the abrasive test sample was used, which was a 4.54 Kg block of brass fitted with a 60 cm long articulated handle.

Procedure

A 5.71 cm by 10.2 cm abrasive test sample was adhered to the sanding fixture with double-sided adhesive tape. Using this test sample fixture, the plastic panel work piece was sanded for 10 cycles to establish the initial scratch pattern for measurement. One cycle was completed when the test fixture is pushed the length of the panel, then pulled back to the starting point (a total of 121.2 cm of linear travel.)

The accumulated dust was blown off the panel and the test sample using compressed air. The surface roughness of the sanded portion of the plastic panel was measured with a PERTHOMETER model M4P. The results are recorded below in Table 1. This entire procedure was repeated with fresh test panels for each abrasive product type evaluated.

Cut Testing

"Cut-Rate", refers to the ability of the abrasive to remove stock material or surface particles from the work piece. The "Cut-Rate" is the amount of weight loss of the work piece over time.

A fixture to support the 5.71 cm by 10.2 cm abrasive test sample is a 4.54 Kg brass block, with a 60 cm long handle. The abrasive was held in place using double-sided adhesive tape, the same piece as was used before in the plastic panel test.

The work piece used was a painted, 40.3 cm by 60.6 cm, medium density fiberboard panel painted with three coats (127 μin. (5 mils) wet) of Sherwin-Williams water-borne interior acrylic, semi-gloss paint available under the trade designation Sherwin-Williams Pro Classic. The work piece was weighed with an accurate electronic balance before the paint-sanding test began. Using the sample test fixture, the painted panel was sanded for a total of 50 cycles. Every 10 cycles during the sanding test the painted panel and the test fixture sample were cleaned of accumulated dust by blowing with compressed air. The painted panel was re-weighed to establish the weight loss (Cut) during the 10 cycle process. The cumulative weight loss for each 10 cycle test was recorded below up to a total of 50 cycles.

After the paint panel testing was complete the abrasive test sample was cleaned of accumulated dust with compressed air and the plastic panel steps were repeated to establish the final scratch pattern for the test sample.

The entire procedure was repeated with fresh test panels for each abrasive product type evaluated.

Example 13

Figure 2:
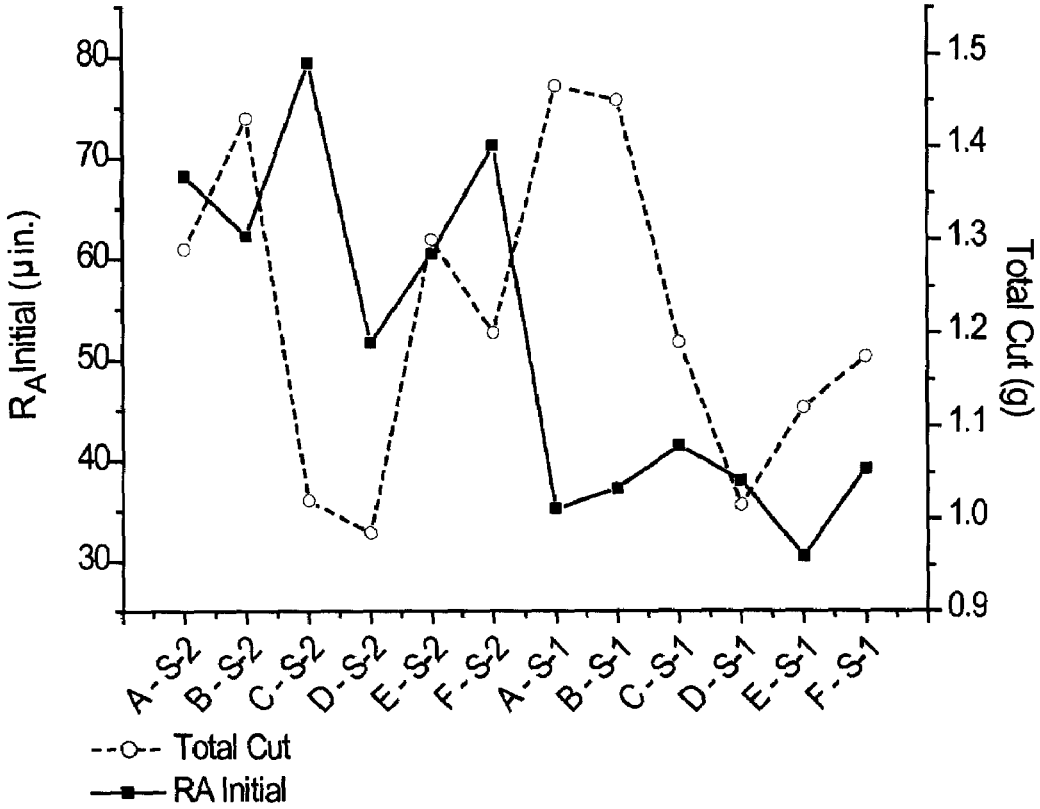
FIG. 2 is a graphical representation of the data presented in Table 1.

This example describes the comparative finish and cut testing of Examples 1-12, flexible abrasives of the 5 substrates, each with Formulation S-1 and Formulation S-2. Procedure as described above was allowed. Results are summarized in Table 1 and in FIG. 2.

TABLE 1

Scratch Finish Results Measured (micrometers) and Paint Sanding Results Cumulative Weight Loss (grams)

| | Initial Scratch Finish | | Total Cut | |
|---|---|---|---|---|
| Substrate | Formulation S-2 | Formulation S-1 | Formulation S-2 | Formulation S-1 |
| A | 68.3 | 35.3 | 1.29 | 1.47 |
| B | 62.3 | 37.3 | 1.43 | 1.45 |
| C | 79.5 | 41.5 | 1.02 | 1.19 |
| D | 51.8 | 38.0 | 0.99 | 1.02 |

TABLE 1-continued

Scratch Finish Results Measured (micrometers) and Paint Sanding Results Cumulative Weight Loss (grams)

| | Initial Scratch Finish | | Total Cut | |
|---|---|---|---|---|
| Substrate | Formulation S-2 | Formulation S-1 | Formulation S-2 | Formulation S-1 |
| E | 60.5 | 30.5 | 1.30 | 1.12 |
| F | 71.3 | 39.3 | 1.20 | 1.18 |

The results of the paint removal testing and scratch/finish testing demonstrate that the Formulation S-1, which has a lower Young's modulus than Formulation S-2, provides a similar or improved cut and improved scratch finish when compared to Formulation S-2. This result is independent of the substrate tested.

It will be apparent to those of ordinary skill in the art that various changes and modifications may be made without deviating from the inventive concept set forth above. Thus, the scope of the present invention should not be limited to the structures described in this application, but only by the structures described by the language of the claims and the equivalents of those structures.

What is claimed is:

1. An abrasive article, comprising:

(a) a substrate having opposed first and second surfaces;

(b) a make coat on at least a portion of said first surface;

(c) abrasive mineral particles on at least a portion of said make coat to provide an abrasive surface; and (d) a size coat arranged over at least a portion of said abrasive surface, said size coat having a Young's modulus less than 100,000 psi.

2. An abrasive article as defined in claim 1, wherein the substrate is resilient.

3. An abrasive article as defined in claim 1, wherein the substrate is continuous.

4. An abrasive article as defined in claim 1, wherein the make coat has a Young's modulus of less than 100,000 psi.

5. An abrasive article as defined in claim 1, wherein the make coat has an elongation of 10% to 400%.

6. An abrasive article as defined in claim 1, wherein the make coat is a binder selected from the group consisting of acrylate resins, epoxy resins, polyol modified epoxy resins, ethylenically unsaturated resins, nitrile rubber resins, urethane resins, aminoplast resins, acrylated isocyanurate resins, isocyanurate resins, acrylated urethane resins, acrylated epoxy resins, phenolic resins, urea-formaldehyde resins, polyvinyl chloride resins, butadiene rubber resins, and combinations thereof.

7. An abrasive article as defined in claim 1, wherein the size coat has an elongation of 10% to 400%.

8. An abrasive article as defined in claim 1, wherein the size coat has an elongation of 50%-100%.

9. An abrasive article as defined in claim 1, wherein the size coat is a binder resin selected from the group consisting of acrylate resins, epoxy resins, polyol modified epoxy resins, ethylenically unsaturated resins, nitrile rubber resins, urethane resins, aminoplast resins, acrylated isocyanurate resins, isocyanurate resins, acrylated urethane resins, acrylated epoxy resins, phenolic resins, urea-formaldehyde resins, polyvinyl chloride resins, butadiene rubber resins, and combinations thereof.

10. An abrasive article as defined in claim 1, wherein the abrasive particles comprise material selected from the group consisting of fused aluminum oxide, heat treated aluminum oxide, silicon carbide, alumina-based ceramics, zirconia, alumina-zirconia, diamond, ceria, cubic boron nitride, garnet, ground glass, quartz, titanium diboride, shells, pumice, talc, calcium carbonate, synthetic plastics, and combinations thereof.

11. An abrasive article, comprising:

(a) a resilient substrate having opposed first and second surfaces;

(b) a make coat on at least a portion of said first surface;

(c) abrasive mineral particles on at least a portion of said make coat to provide an abrasive surface; and (d) a size coat arranged over at least a portion of said abrasive surface, said size coat having a Young's modulus less than 100,000 psi;

wherein a ratio of make coat weight to size coat weight is from 1:1 to 1:5 and a total thickness of the make coat and size coat is less than 90% of a mineral grain height of the abrasive mineral particles.

12. An abrasive article as defined in claim 11, wherein the substrate is resilient.

13. An abrasive article as defined in claim 11, wherein the substrate is continuous.

14. An abrasive article as defined in claim 11, wherein the make coat has a Young's modulus of less than 100,000 psi.

15. An abrasive article as defined in claim 11, wherein the make coat has an elongation of 10% to 400%.

16. An abrasive article as defined in claim 11, wherein the make coat is a binder selected from the group consisting of acrylate resins, epoxy resins, polyol modified epoxy resins, ethylenically unsaturated resins, nitrile rubber resins, urethane resins, aminoplast resins, acrylated isocyanurate resins, isocyanurate resins, acrylated urethane resins, acrylated epoxy resins, phenolic resins, urea-formaldehyde resins, polyvinyl chloride resins, butadiene rubber resins, and combinations thereof.

17. An abrasive article as defined in claim 11, wherein the size coat has an elongation of 10% to 400%.

18. An abrasive article as defined in claim 11, wherein the size coat as an elongation of 50%-100%.

19. An abrasive article as defined in claim 11, wherein the size coating is a binder resin selected from the group consisting of acrylate resins, epoxy resins, polyol modified epoxy resins, ethylenically unsaturated resins, nitrile rubber resins, urethane resins, aminoplast resins, acrylated isocyanurate resins, isocyanurate resins, acrylated urethane resins, acrylated epoxy resins, phenolic resins, urea-formaldehyde resins, polyvinyl chloride resins, butadiene rubber resins, and combinations thereof.

20. An abrasive article as defined in claim 11, wherein the abrasive particles comprise material selected from the group consisting of fused aluminum oxide, heat treated aluminum oxide, silicon carbide, alumina-based ceramics, zirconia, alumina-zirconia, diamond, ceria, cubic boron nitride, garnet, ground glass, quartz, titanium diboride, shells, pumice, talc, calcium carbonate, synthetic plastics, and combinations thereof.

21. An abrasive article, comprising:

(a) a substrate comprising a multiplicity of separated resilient bodies connected to each other in a generally planar array in a pattern which provides open spaces between adjacent connected bodies, each body having opposed first and second surfaces;

(b) a make coat on at least a portion of said first surface, wherein said make coat is a polyester urethane acrylate blend having a Young's modulus of no greater than 100,000 psi;

(c) abrasive mineral particles on at least a portion of said make coat to provide an abrasive surface; and (d) a size coat arranged over at least a portion of said abrasive surface, wherein said size coat is a mixture of a polyol modified epoxy resin and an acrylate resin, said mixture having a Young's modulus less than 100,000 psi;

wherein the ratio of make coat weight to size coat weight is from 1:1 to 1:5 and a total thickness of the make coat and size coat is less than 90% of a mineral grain height of the abrasive mineral particles.

* * * * *